United States Patent [19]

Fleissner

[11] Patent Number: 4,611,476

[45] Date of Patent: Sep. 16, 1986

[54] APPARATUS FOR THE CONTINUOUS WASHING OF LENGTHS OF TEXTILE MATERIAL

[75] Inventor: Gerold Fleissner, Chur, Switzerland

[73] Assignee: Vepa Aktiengesellschaft, Switzerland

[21] Appl. No.: 675,952

[22] Filed: Nov. 28, 1984

[51] Int. Cl.[4] ..... D06B 5/08

[52] U.S. Cl. ..... 68/158; 68/175; 68/DIG. 5; 118/419

[58] Field of Search ..... 68/158, 175, DIG. 5; 118/419, 420

[56] References Cited

U.S. PATENT DOCUMENTS

| | | | |
|---|---|---|---|
| 1,321,977 | 11/1919 | Burg | 118/420 X |
| 1,875,701 | 9/1932 | Brownell | 118/420 X |
| 2,012,176 | 8/1935 | Tevander | 118/420 X |
| 2,581,638 | 1/1952 | Deering | 118/419 X |
| 2,960,963 | 11/1960 | Shelton | 68/175 X |
| 3,440,843 | 4/1969 | Fleissner | 68/DIG. 5 |
| 3,548,784 | 12/1970 | Wenger | 118/419 |

FOREIGN PATENT DOCUMENTS

| | | | |
|---|---|---|---|
| 642495 | 5/1964 | Belgium | 68/DIG. 5 |
| 2051156 | 1/1981 | United Kingdom | 68/175 |
| 711207 | 1/1980 | U.S.S.R. | 68/DIG. 5 |

*Primary Examiner*—Philip R. Coe

*Attorney, Agent, or Firm*—Antonelli, Terry & Wands

[57] ABSTRACT

In an apparatus for the continuous washing of a length of textile material, the textile material runs over several guide rolls, at least one of which is arranged below the liquid level in the washing vessel. In order to be able to skip a washing device, in a continuous plant, so that the length of material does not enter the liquid and causes contamination therein, for example, the invention provides to mount the guide element to be movable out of the vessel. Therefore, the length of material still passes around all of the guide rolls of the washing device, but in this case outside of the liquid charged into the vessel.

3 Claims, 1 Drawing Figure

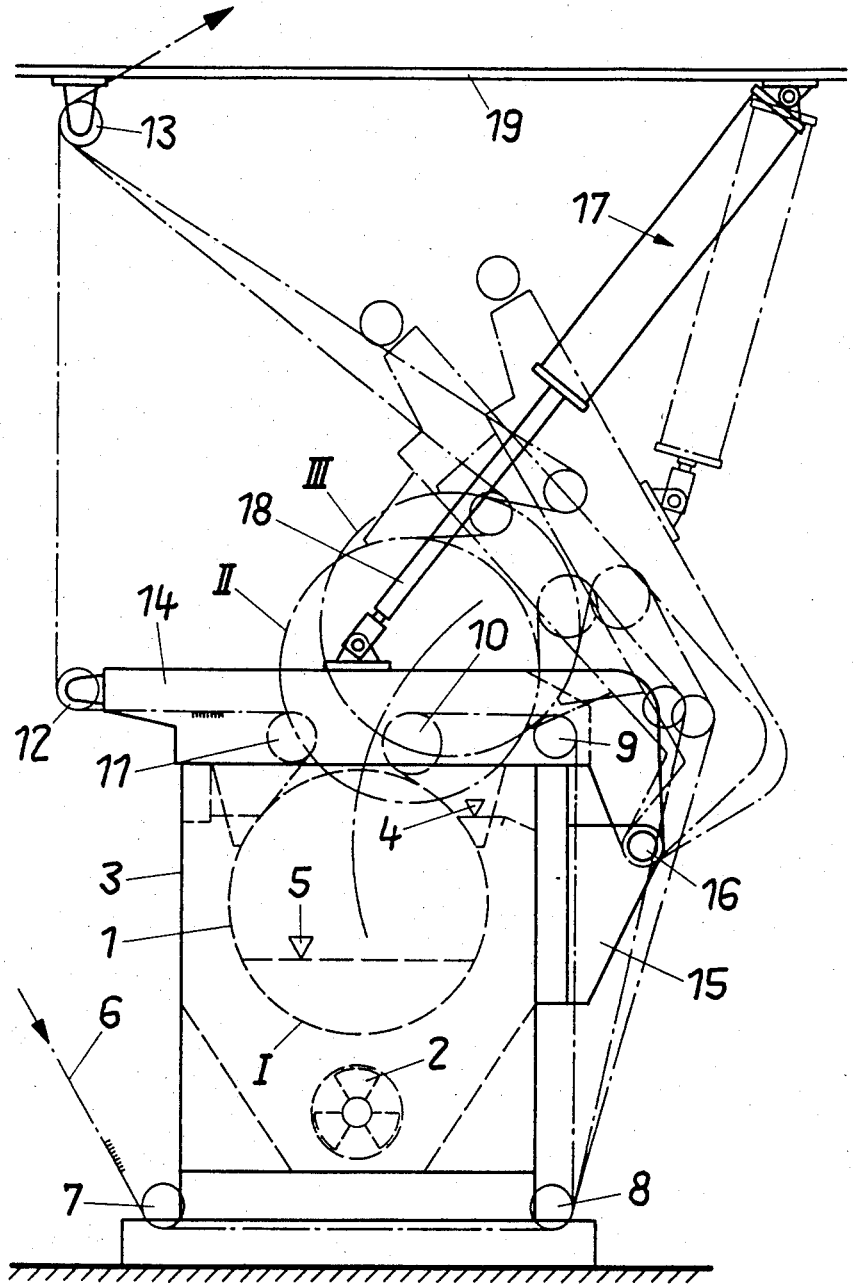
13
19
17
III
18
II
14
10
12
11
9
4
3
5
16
1
15
6
I
2
7
8

APPARATUS FOR THE CONTINUOUS WASHING OF LENGTHS OF TEXTILE MATERIAL

The invention relates to an apparatus for the continuous washing of lengths of textile material, with a vessel wherein at least one guide element, looped around by the textile material, is arranged below the liquid level.

A large number of various constructions of devices of the above-mentioned type has been known, arranged at all possible locations in a continuous installation for performing the washing step necessary at that point. Essentially, in a continuous plant for the dyeing or printing of a textile material, washing is required after the steaming process to remove the unfixed dye residues; this takes place, in part, under hot conditions but essentially in the cold state. After this washing step, the textile material then enters a dryer. In such a continuous plant, the printing machine or a solid-dyeing unit is arranged upstream of the steamer; the printer or dyer, in turn, has a washing device of the aforementioned type connected in front thereof, since a perfect printing or dyeing of the textile material is possible only if all impurities, such as also finishes and spooling oils, have been removed from the textile material. In case of pile-type textiles, it is additionally necessary to orient the nap uniformly prior to printing and dyeing, respectively. All of this takes place in the washing unit located upstream of the dyeing station; in order to fulfill the posed tasks, this washing unit must run at a high temperature.

In order to be able to operate such a plant continuously, a leader must be guided around the plurality of guide rolls. After each change in batch, but in any event with each new, altered printing procedure, such a leader must be attached to the exiting material, for example a carpet; this leader then passes through the installation until the exiting batch has been finally deposited in the dry state.

The leader then also serves for feeding the new batch, so that the leader is subjected to all processing steps within the continuous plant, including the dyeing or printing process. Since the material of the leader is only extremely rarely made of the fibers such as the material to be produced, the dyes applied to the leader in the dyeing station are not fixed in the steamer, but also, these dyes are not entirely washed out in the subsequent washing station, especially because the washing step therein does not take place entirely in the hot state. If, now, this dried leader is reused and attached to a new batch, which is always done for economical reasons, then this always reused material also passes through the prewash bath which, according to its purpose, must be operated in the hot state. This washing step to which the leader is subjected upstream of the plant causes a bleeding out of the unfixed dye still present in the leader whereby the prewash bath is contaminated and consequently the first few meters of the production material following the leader are contaminated as well. For this reason, the first few meters of a newly fed material are always rejects.

The problem is, of course, eliminated if the leader is in each case thoroughly laundered or if, prior to the feeding of the new production material, the installation is halted, the water of the prewash bath is replaced, and the bath is reheated. Also, thought has been given to making the leader of a nonwoven mat that can be discarded. However, all of these suggestions foundered on the considerable costs for the missing production efficiency of the plant, for water, for energy, or the additional expenses for such a nonwoven mat, especially since a frequent changing of batches is a customary procedure.

The invention is based on the object of finding a solution for this problem, namely making it possible that the continuous plant can be passed through, as heretofore, by a repeatedly used leader without there being the danger of contamination of the liquid in the prewash bath by dye residues adhering to the leader.

In order to attain this object, the invention provides that this guide element of the prewashing device, located below the liquid level, is mounted so that it can be moved, e.g. pivoted, out of its functional position within the bath, to outside of the vessel. On account of this construction, the prewashing bath must now be operated with the guide element swung out whenever the installation is passed through by the leader. Although the leader will pass around all of the rollers of the prewashing bath, this will take place without the leader coming into contact with the hot washing liquid. The hot washing liquid thus remains clean for the subsequent carpet or the like; the liquid need not be replaced and need not be reheated. The moving out of the guide element is possible in case of a simple guide roller just as well as in case of a sieve drum arranged at this location and being traversed by the flow from the outside toward the inside. For this purpose, it is merely necessary to mount the bearings for the sieve drum, including the feeding and take-off rollers for the textile material, at a traverse provided above the bath, rather than, as heretofore, at the end wall of the vessel. The movements of the guide element should take place automatically, for example with the aid of a pressure piston-cylinder unit.

One embodiment of the apparatus of this invention is illustrated in the drawing.

The FIGURE shows, in cross section, a sieve drum washing machine, the sieve drum 1 of which is traversed from the outside toward the inside by a flow of washing liquid. For this purpose, a level 4 is produced outside of the sieve drum 1 by means of the pump 2 within the liquid tank 3, which pump is arranged at the end face, while the liquid that has passed through the sieve drum 1 is drained at the open end face of the sieve drum into a collecting tank arranged at that location, so that the lowered level 5 is formed within the sieve drum. The sieve drum is enveloped by the length of textile material 6 resting with its back side on this drum; for this purpose, the textile material is guided, coming from the left, over guide rolls 7–10 to the sieve drum 1 and is then conducted via the guide rolls 11–13 to the subsequent machine, not shown. The mode of operation of the sieve drum washing machine under suction draft is generally known so that no additional explanations are deemed necessary.

In contrast to the conventional construction, the sieve drum is not rotatably supported in the end walls of the tank 3 but rather in a separate holding structure, of which the traverse 14, to be provided above the bath, is illustrated. This traverse rotatably supports not only the guide rolls 9–12, but also the sieve drum 1. In order to be able to swing the sieve drum 1 out of the vessel 2, the traverse 14 is pivotably supported about the joint 16 attached to a flange 15. The individual pivotal positions of the traverse 14, together with the sieve drum, are shown in dot-dash lines. In position I, the sieve drum 1 is in the operative arrangement within the bath for prewashing of the carpet, for example, with liquid heated to the boiling temperature. In position II, the sieve drum 1 is swung out of the bath so that at this point in time the leader will no longer come in contact with the liquid at the height of level 4 and accordingly cannot contaminate the bath, either. Cleaning of the sieve drum 1 is possible in a simple way in this position, as well as in position III.

The movement of the sieve drum into the pivotal positions I–III and back is accomplished with the aid of a pressure piston-cylinder unit 17, the piston 18 of which engages the traverse 14 perpendicularly above the axis of the sieve drum, while the cylinder of the unit is pivotably mounted to a trestle 19 above the washing device.

What is claimed is:

1. An apparatus for the continuous washing of a length of textile material which comprises a vessel containing a liquid for washing and textile material; a sieve drum, looped about by the textile material, arranged below a liquid level in said vessel; a stationary support means; a transverse pivotally mounted on said support means; said sieve drum being rotatably supported by said traverse and being movable from an operative position within the vessel to an inoperative position out of the vessel upon swinging of said traverse about the support means; feeding and take-off rollers operatively associated with the sieve drum for, respectively, feeding the length of textile material onto and for taking off the textile material from the sieve drum, said rollers being supported on said traverse; and pump means for maintaining the liquid level within said vessel; said traverse being movable to an incline position whereby the sieve drum is arranged above the liquid level whereby a leader portion of the textile material guided by said rollers will not contact the liquid and thereby avoid contaminating the liquid during feeding of the leader portion onto said sieve drum.

2. An apparatus according to claim 1, wherein the stationary support means is attached to a side of said vessel.

3. An apparatus according to claim 2, wherein a piston of a pressure piston-cylinder unit engages the traverse to effect pivoting of the traverse; said piston being secured to a tressel above said vessel.

* * * * *